US005639227A

United States Patent [19]

Mills

[11] Patent Number: 5,639,227

[45] Date of Patent: Jun. 17, 1997

[54] SEAL ARRANGEMENT FOR THE DRIVEHEAD OF A DOWNHOLE ROTARY PUMP

[75] Inventor: Robert A. R. Mills, Bragg Creek, Canada

[73] Assignee: Kudu Industries, Inc., Canada

[21] Appl. No.: 555,316

[22] Filed: Nov. 8, 1995

[51] Int. Cl.[6] ..... F04B 35/04

[52] U.S. Cl. ..... 417/423.11; 417/410.3; 417/423.12; 417/424.1; 384/477; 277/68; 277/110; 277/115

[58] Field of Search ..... 417/410.3, 424.1, 417/423.11, 423.12, 904; 418/48; 277/110, 105, 115, 117, 19, 23, 68; 384/477

[56] References Cited

U.S. PATENT DOCUMENTS

| | | | |
|---|---|---|---|
| 1,688,941 | 10/1928 | Schlegel | 277/19 |
| 2,949,321 | 8/1960 | Tracy | 277/68 |
| 4,289,317 | 9/1981 | Kuc | 277/115 |

*Primary Examiner*—Charles G. Freay
*Attorney, Agent, or Firm*—Andrus, Sceales, Starke & Sawall

[57] ABSTRACT

A leakproof seal arrangement is disclosed for use in the drivehead of a downhole rotary pump, which pump is operated by a drive string suspended from the drivehead for rotation in a production tubing about a longitudinal axis, the drivehead having a bore in fluid communication and coaxial with the production tubing and sized to permit the passage of a polished rod attached to a top end of the drive string. The seal arrangement includes a centralizer sleeve for receiving a portion of the polished rod; a bearing for rotatably supporting the centralizer sleeve in the drivehead coaxial with the bore, whereby an annular gap is created between the centralizer sleeve and an opposite, cylindrical wall of the drivehead which gap is in fluid communication with the production tubing. The seal arrangement further includes a centering packing for sealingly and concentrically connecting the centralizer sleeve with the polished rod for simultaneous rotation about the longitudinal axis. The centering packing is sufficiently elastic to accommodate wobble of the polished rod in the centralizer sleeve while preventing leakage of a pumped liquid present in the production tubing and the centralizer sleeve during operation of the pump. The seal arrangement also includes an annular drivehead seal for sealing the annular gap which is also filled with the pumped liquid during operation of the pump, to substantially prevent leakage of the pumped liquid from the drivehead. With this seal arrangement, polished rod wobble compensation and sliding sealing of the drivehead are carried out at separate locations in the drivehead which results in a more reliable seal and reduced stress on the seal materials used and provides the seal with an extended service period.

20 Claims, 3 Drawing Sheets

SEAL ARRANGEMENT FOR THE DRIVEHEAD OF A DOWNHOLE ROTARY PUMP

FIELD OF THE INVENTION

The invention relates to downhole rotary pumping arrangements and more particularly to drivehead seals used in the driveheads of downhole rotary pumps.

BACKGROUND OF THE INVENTION

Downhole rotary pumps, such as progressing cavity pumps, are used for the conveying of different types of fluids, but are especially well suited for the pumping of very viscous or thick liquids such as crude oil laden with sand. A downhole rotary pump is operated by a drive string, generally consisting of a rod or tube string that extends down the well bore. The drive string rotates in a stationary production tubing and is suspended from and rotated by a drivehead assembly which is associated with the wellhead. The drivehead assembly is generally mounted to the top of a wellhead which is attached to the top end of the production tubing. A polished rod is attached to the upper end of the drive string and extends through the drivehead to facilitate sealing around the drive string. The pump includes a stator connected to the bottom end of the production tubing and a rotor attached to the bottom end of the drive string. Upon actuation of the pump by rotation of the drive string, the pumped liquid is forced to the ground surface through the annular space provided between the string and the production tubing.

In conventional downhole rotary pump driveheads, a stuffing box is used to seal the annular space between the tubing and the string in the drivehead and above the pumped liquid take-off valve of the wellhead. The stuffing box is generally mounted in a bottom end of the drivehead to tightly seal around the rotating polished rod. In order to reduce wear of the stuffing box and to provide adequate lubrication of the polished rod/stuffing box interface, the fit of the stuffing box around the string is adjusted such that a controlled leakage of about 2 to 3 drops of pumped liquid per minute is achieved. This constant leakage, although at a relatively low rate, can result in the accumulation of significant amounts of spilled liquid over long periods of operation. Recently, political pressure by environmental groups and the enactment of laws in many jurisdictions which require "clean" wellheads, have forced well operators to reduce the stuffing box leakage rate. However, the resulting lesser lubrication causes considerably higher stuffing box and polished rod wear. Furthermore, wobble of the polished rod, which is especially prevalent with Moineau type pumps and must be compensated by the stuffing box if a reliable seal is to be achieved, places additional stress on the sealing material respectively used. Thus, a reliable and durable seal is desired, which will not allow unacceptable leakage.

SUMMARY OF THE INVENTION

It is now an object of the present invention to provide an improved seal arrangement for the drivehead of a downhole rotary pump which substantially eliminates leakage of the pumped liquid from the drivehead and over an extended service period.

It is a further object of the invention to provide a seal arrangement wherein the polished rod wobble compensation and sliding sealing of the drivehead are carried out at separate locations in the drivehead to achieve a more reliable seal and to reduce the stress on the seal material respectively used.

This is achieved in a leakproof seal arrangement in accordance with the invention for use in the drivehead of a downhole rotary pump, which pump is operated by a drive string suspended from the drivehead for rotation in a production tubing about a longitudinal axis, the drivehead having a bore in fluid communication and coaxial with the production tubing and sized to permit the passage of a polished rod attached to a top end of the drive string. The seal arrangement in accordance with the invention includes:

- a centralizer sleeve for receiving a portion of the polished rod;
- means for rotatably supporting the centralizer sleeve in the drivehead coaxial with the bore, whereby an annular gap is created between the centralizer sleeve and an opposite, cylindrical wall of the drivehead which gap is in fluid communication with the production tubing;
- centering means for sealingly and concentrically connecting the centralizer sleeve with the polished rod for simultaneous rotation about the longitudinal axis, the centering means being sufficiently elastic to accommodate wobble of the polished rod in the centralizer sleeve while preventing leakage of a pumped liquid present in the production tubing and the centralizer sleeve during operation of the pump; and
- an annular drivehead seal for sealing the annular gap which is also filled with the pumped liquid during operation of the pump, to substantially prevent leakage of the pumped liquid from the drivehead.

In a preferred embodiment, the drivehead seal is of elastically deformable high temperature resistant seal material and the seal arrangement further includes a means for preventing the drivehead seal from rotating relative to the drivehead.

In another aspect, the invention provides a drivehead for a downhole rotary pump which includes a bore in fluid communication with the production tubing and sized to permit the passage of a polished rod attached to a top end of a drive string of the pump, and a seal arrangement for reliably sealing the polished rod in the drivehead to substantially prevent leakage of the pumped liquid from the drivehead. The seal arrangement includes:

- a centralizer sleeve for receiving a portion of the polished rod;
- means for rotatably supporting the centralizer sleeve in the drivehead coaxial with the bore, whereby an annular gap is created between the centralizer sleeve and an opposite, cylindrical wall of the drivehead which gap is in fluid communication with the production tubing;
- centering means for sealingly and concentrically connecting the centralizer sleeve with the polished rod for simultaneous rotation about the longitudinal axis, the centering means being sufficiently elastic to accommodate wobble of the polished rod in the centralizer sleeve while preventing leakage of a pumped liquid present in the production tubing and the centralizer sleeve during operation of the pump; and
- an annular drivehead seal for sealing the annular gap which is also filled with the pumped liquid during operation of the pump, to substantially prevent leakage of the pumped liquid from the drivehead.

The means for centering is preferably a packing which is incorporated into or mounted to the top end of the centralizer sleeve.

The seal arrangement preferably further includes a dirt exclusion seal positioned in the annular gap to prevent dirt suspended in the pumped liquid from reaching the drivehead seal. Furthermore, a packing is preferably positioned in the annular gap to provide a back-up seal to the drivehead seal.

BRIEF DESCRIPTION OF THE DRAWINGS

The invention will now be further described by way of example only and with reference to the attached drawings, wherein.

DETAILED DESCRIPTION OF THE PREFERRED EMBODIMENT

Figure 1:
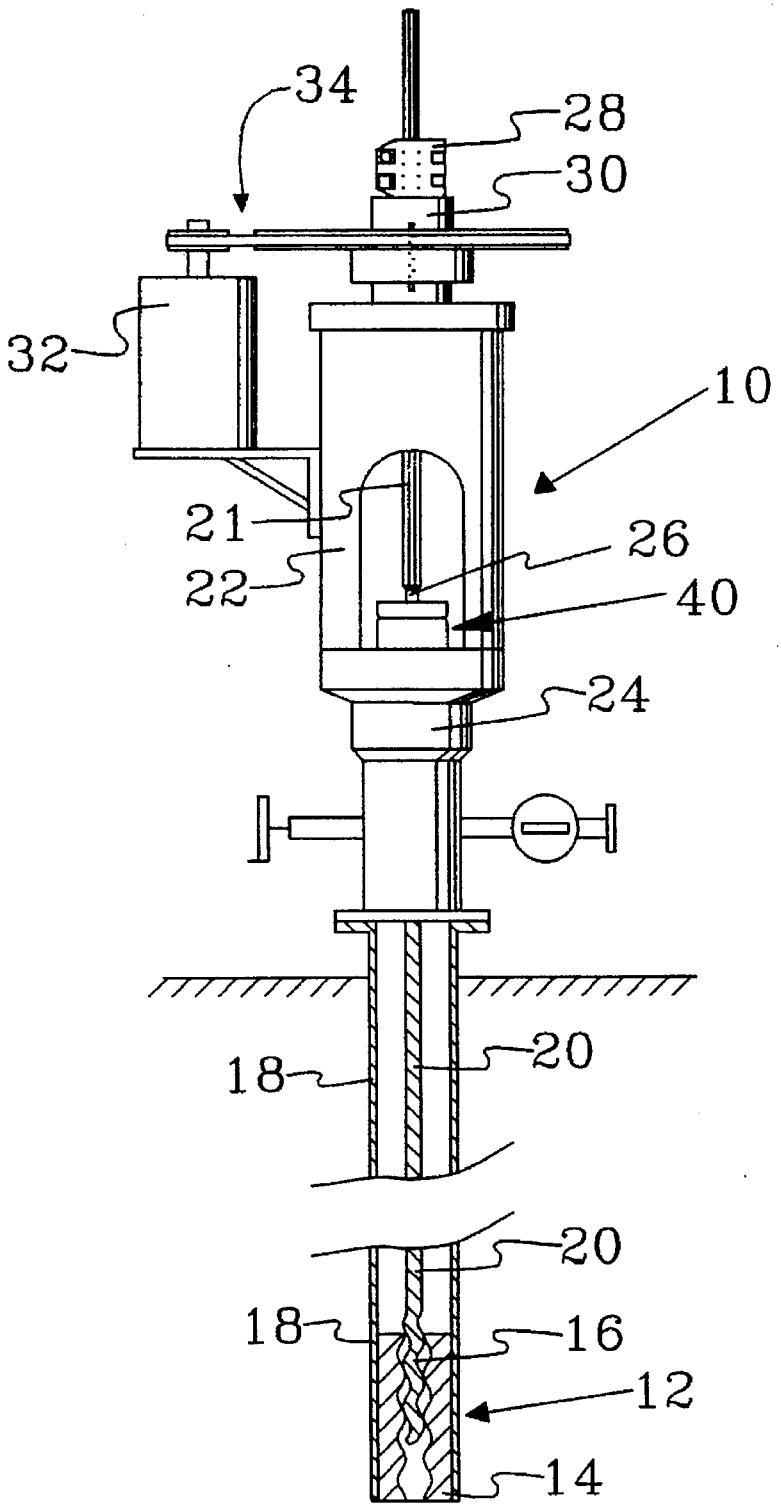
FIG. 1 is a schematic side elevational view of a rotary downhole pump arrangement which is operated by a drivehead including a seal arrangement in accordance with the invention.

Leakproof seal arrangements in accordance with the invention are intended for use in a downhole rotary pump assembly as shown in FIG. 1 and especially in the drivehead 10 thereof which is used for the operation of a progressing cavity downhole pump 12 including a stator 14 and a rotor 16. The stator 14 is connected to the bottom end of a production tubing 18 and the rotor 16 is mounted to the bottom end of a drive string 20 which is suspended from the drivehead 10 and generally consists of a plurality of connected sucker rods or tubes (not illustrated). The drivehead 10 includes a frame 22 which is concentrically screwed onto the top end of a conventional wellhead assembly 24 for downhole rotary pumps. The drive string 20 includes a polished rod 26 which is affixed to a top end of the sucker rod or tube string and extends through a bore in the drivehead frame 22 as will be described below in detail with reference to FIG. 3. The drive string 20 is suspended from the drivehead 10 by way of a clamp 28 which is shaped to accommodate an end of the polished rod 26 that protrudes upward from a drive spindle 30 of the drivehead 10. The clamp 28 is fastened to the drive string above the drivehead and rests on a top surface of the drive spindle 30. A slip shaft 21, preferably of hexagonal cross-section (available from KUDU Industries, Calgary, Canada) may be attached to the top end of the polished rod 26 to permit adjustment of the axial position of the drive string 20 in the tubing 18 and the drive spindle 30, while ensuring the reliable, slip-free transmission of torque to the drive string. In that case, the clamp 28 is mounted on the slip shaft. Torque from an electric motor 32 is transmitted to the drivehead 10 and the drive string 20 by way of a conventional V-belt and pulley arrangement 34 well known to persons of skill in the art of rotary downhole pumping arrangements. Alternatively, the drive spindle 30 may be driven by a right-angle gear drive powered by an internal combustion engine (not illustrated), or a comparable power source, in a manner well known in the art. Leakage of the pumped fluid, which is conveyed in the annular space between the production tubing and the drive string, is substantially prevented by a seal arrangement 40 in accordance with the invention which is incorporated into the drivehead 10.

Figure 2:
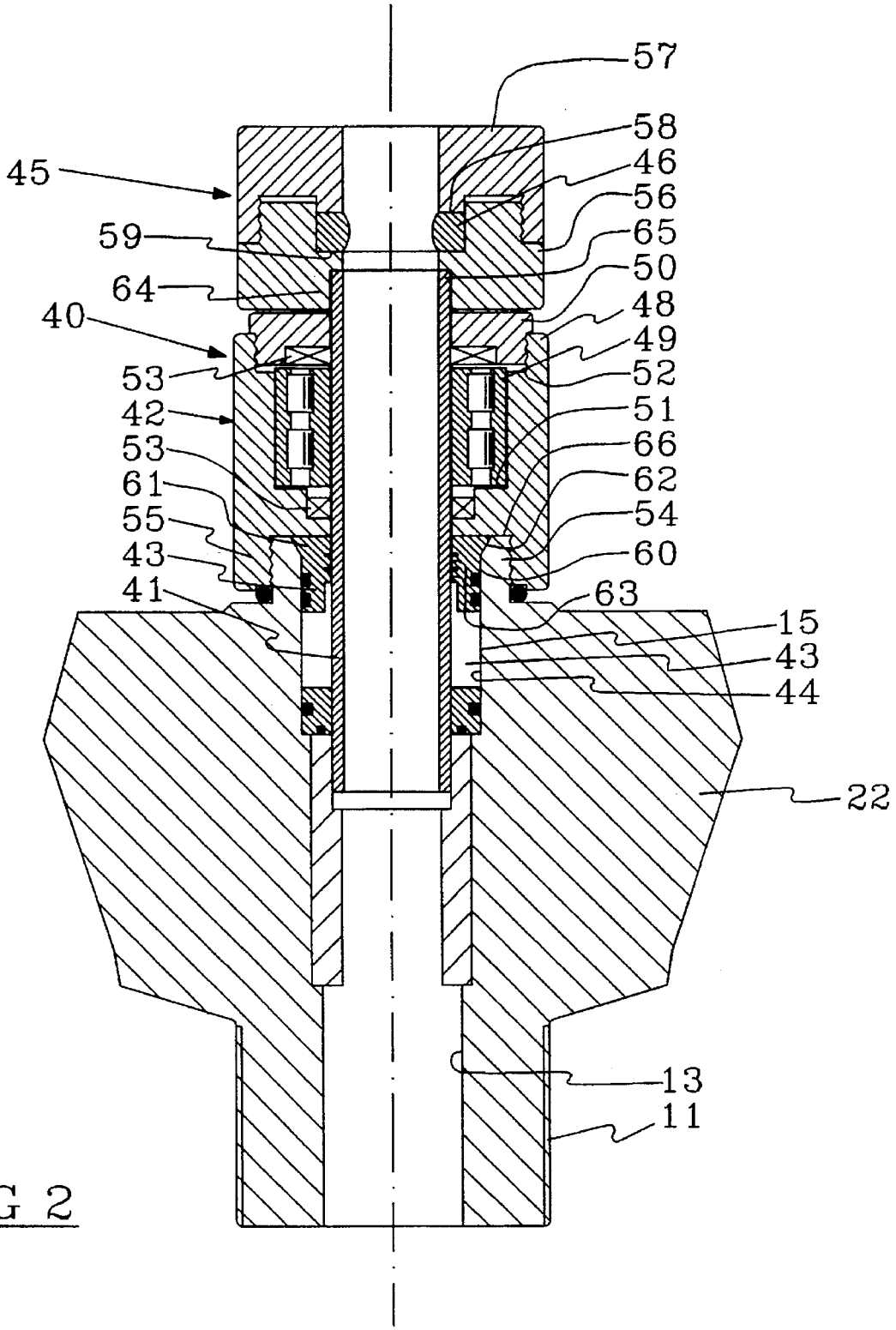
FIG. 2 is an axial cross-section through a preferred embodiment of a seal arrangement in accordance with the invention.

The preferred embodiment of a seal arrangement in accordance with the invention as shown in FIG. 2 is intended for use with a drivehead 10 having a threaded pin connection 11, or another suitable connection known in the art, for attachment to the top end of a wellhead 24 (see FIG. 1). The drivehead has a central bore 13 in fluid connection and coaxial with the production tubing 18 (see FIG. 1).

Figure 3:
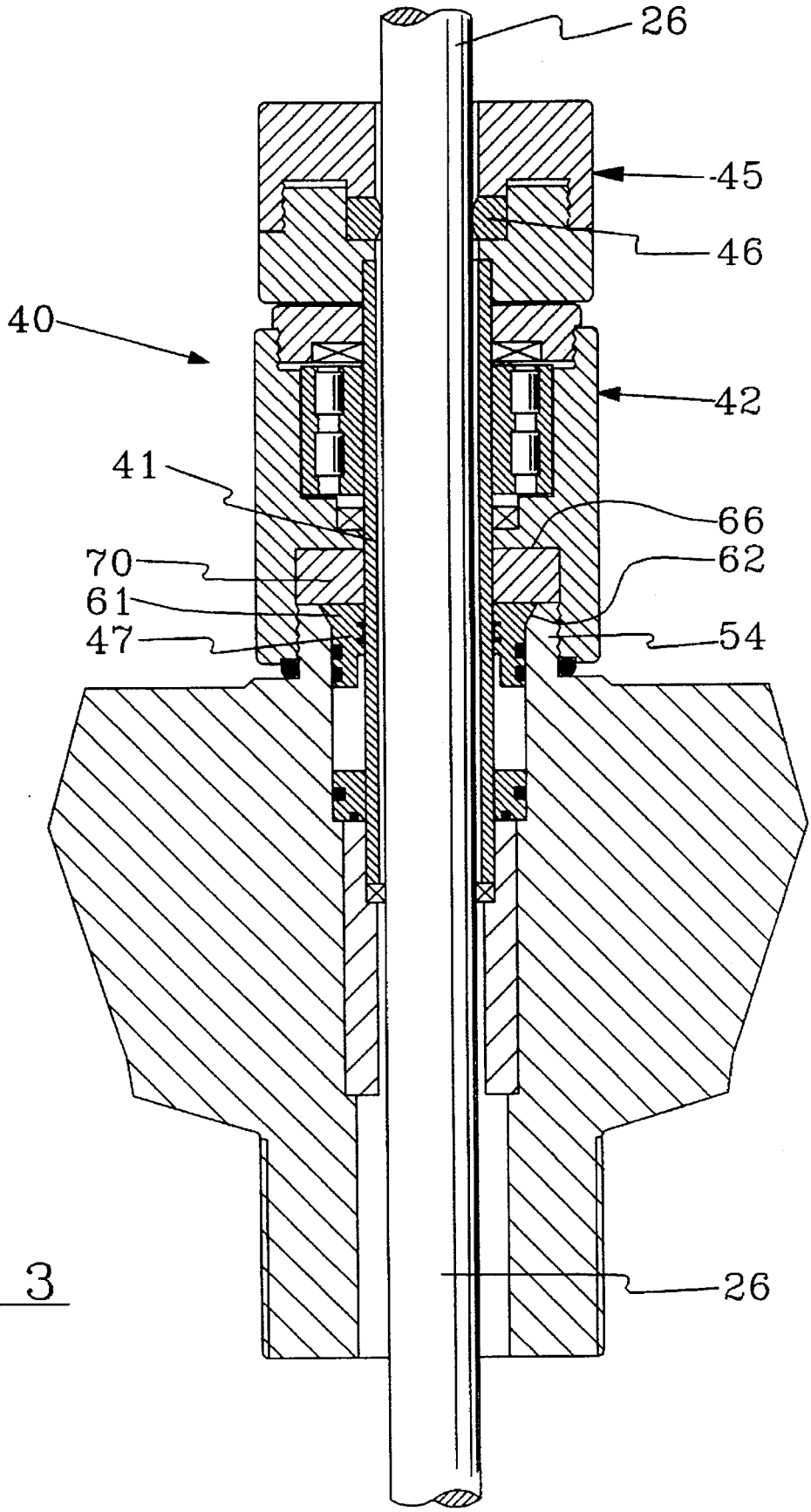
FIG. 3 illustrates the seal arrangement shown in FIG. 2 in cross-section and with a polished rod extending therethrough.

The seal arrangement 40 includes a centralizer sleeve 41 receiving a portion of the polished rod 26 (see FIGS. 1 and 3). A lower portion of the centralizer sleeve 41 is received in a counter bore 15 in the drivehead 10. The centralizer sleeve 41 is rotatably supported in the drivehead 10 and coaxial with the bore 13 by a bearing assembly 42, whereby an annular gap 43 is created between the centralizer sleeve and an opposite wall 44 of the counter bore 15, which gap is in fluid communication with the central bore 13 and, thus, the production tubing 18 (see FIG. 1). The polished rod 26 extends through the centralizer sleeve 41 (see FIG. 3) when the drivehead is in operation and is centered therein by a packing assembly 45 mounted to a top end of the centralizer sleeve 41. The interior of the centralizer sleeve, which is also in fluid communication with the production tubing 18 (see FIG. 1), is sealed around the polished rod 26 by the packing assembly to prevent leakage of the pumped fluid therefrom. The packing assembly 45 also connects the centralizer sleeve 41 with the polished rod 26 for simultaneous rotation therewith during operation of the downhole pump 12 (see FIG. 1). The packing assembly includes a rubber packing 46 which is made of sufficiently elastic material to accommodate wobble of the polished rod 26 in the centralizer sleeve 41 while reliably preventing leakage of the pumped fluid from the sleeve and around the polished rod. A drivehead seal 47 (see FIG. 3) is provided in the annular gap 43 which seals the gap around the centralizer sleeve 41 to substantially prevent leakage of the pumped liquid around the centralized sleeve. Wear of the centralizer sleeve by the drivehead seal is preferably prevented by hard surfacing. Chrome or tungsten carbide plating are the preferred hard surfacing methods.

The bearing assembly 42 includes a bearing housing 48 enclosing a radial bearing 49 preferably of the dual cylindrical radial roller type, (manufactured by FAG), and a removable bearing housing cap 50 which is screwed onto a top end of the housing. The radial bearing 49 is axially held of the bearing housing 48 between a radially inwardly protruding shoulder 51 in the bearing housing and an annular bottom face 52 of the bearing housing cap 50. The bearing housing 48 is filled with lubricant (not illustrated). A pair of conventional radial lip seals 53 of the low pressure type for retaining lubricant are positioned in the bearing housing above and below the radial bearing 49 to prevent leakage of the lubricant. The bearing assembly 42 is removably mounted to the drivehead frame 22 and coaxially with the central bore 13 by way of an axially protruding threaded mounting collar 54 provided on the drivehead frame 22 and a cooperating internally threaded axial flange 55 on the bearing housing 48.

The packing assembly 45 includes a housing 56 for the conventional packing 46 and a cap 57 screwed onto the housing. The cap 57 and the housing 56 respectively include annular thrust shoulders 58 and 59 for engagement with the axial ends of the packing 46. The thrust shoulders are positioned in axial direction such that when the cap 57 is completely screwed onto the housing 56, the axial distance between the thrust shoulders 58, 59 is less than the length of the packing so that the packing is compressed in axial direction and tightly forced against the polished rod 26 (see FIG. 3) to reliably prevent leakage of the pumped liquid around the polished rod. The housing 56 has an internally threaded axial flange 64 for connection to an externally threaded upper end 65 of the centralizer sleeve. Packings suitable for use in the packing assembly are commercially available from custom manufacturers of elastomeric components.

The drivehead seal 47 is received in a seat 60 provided in the mounting collar 54. The seal has a generally cylindrical shape with an outwardly flared inverse frusto-conical portion 61 at its top end.

The seat 60 is dimensioned to fittingly receive the seal 47 and has an outwardly flared portion 62 complementary to and opposite the frusto-conical portion 61 in the installed condition of the seal (see also FIG. 3). On the radially inner side, the seal 47 is provided with at least one, in this embodiment three, sealing lips 63 for engagement with the centralizer sleeve 41. The dimensions of the frusto-conical portion 61 of the seal are selected such that the seal is held stationary in the flared portion 62 of the seat 60 by a radial bottom wall 66 of the bearing housing 48, when the bearing assembly is affixed to the mounting collar 54. The seal is thereby prevented from rotating. The inner diameter of the sealing lips 63 is selected such that they are radially forced against the centralizer sleeve 41 to reliably prevent leakage of the pumped fluid about the centralizer sleeve. To achieve a seal of extended service life, the seal material is preferably selected from duroelastic materials which have good resistance to high temperatures so that the seal is able to tolerate the significant friction heat created during operation of the pump 12 (see FIG. 1). Especially preferred are seal materials which have self-lubricating properties such as the perfluoro elastomers. The material found most suitable for use in a seal arrangement in accordance with the invention is a perfluorocarbon elastomer available from Dupont under the trade mark KALREZ. A fluorocarbon material such as VITON™ or a polyamide material such as KEVLAR™ can also be used successfully. Suitable materials for this application are often very hard and must be machined from bar stock rather than molded.

A dirt exclusion seal 67 made of similar material is also provided in the annular gap 43 to prevent particles suspended in the pumped liquid from reaching and damaging the drivehead seal 43.

In another preferred embodiment, a conventional packing 70 (see FIG. 3) is positioned above the drivehead seal 47 and between the frusto-conical portion 61 at the top end of the seal and the bottom wall 66 of the bearing housing 48, to provide a backup seal to the drivehead seal. Drivehead seals of the above-described type tend to fail suddenly, which can lead to a substantial spill if the wellhead is not monitored. The back-up packing 70 will prevent such spill and give adequate warning by its small leakage that the drivehead seal needs to be replaced.

Changes and modifications in the specifically described embodiments can be carried out without departing from the scope of the invention which is intended to be limited only by the scope of the appended claims.

The embodiment of the invention in which an exclusive property or privilege is claimed are defined as follows:

1. A leakproof seal arrangement for use in the drivehead of a downhole rotary pump, which pump is operated by a drive string suspended from the drivehead for rotation in a production tubing about a longitudinal axis, the drivehead having a bore in fluid communication and coaxial with the production tubing and sized to permit the passage of a polished rod attached to a top end of the drive string, the seal arrangement comprising:

a centralizer sleeve for receiving a portion of the polished rod;

means for rotatably supporting the centralizer sleeve in the drivehead coaxial with the bore, whereby an annular gap is created between the centralizer sleeve and an opposite, cylindrical wall of the drivehead, which gap is in fluid communication with the production tubing;

centering means for sealingly and concentrically connecting the centralizer sleeve with the polished rod for simultaneous rotation about the longitudinal axis, the centering means being sufficiently elastic to accommodate wobble of the polished rod in the centralizer sleeve while preventing leakage of a pumped liquid present in the production tubing and the centralizer sleeve during operation of the pump; and an annular drivehead seal for sealing the annular gap which is also filled with the pumped liquid during operation of the pump, to substantially prevent leakage of the pumped liquid from the drivehead.

2. A leakproof seal arrangement as defined in claim 1, wherein the drivehead seal is made of elastically deformable high temperature resistant seal material, and the seal arrangement further includes a means for preventing rotation of the drivehead seal in relation to the drivehead.

3. A leakproof seal arrangement as defined in claim 1, wherein the centering means is a packing mounted to a top end of the centralizer sleeve.

4. A leakproof seal arrangement as defined in claim 1, wherein the drivehead seal has a substantially cylindrical shape and a radially outwardly flared portion and the seal arrangement further includes a means for preventing the drivehead seal from rotating, including a seal seat in the drivehead which seat has a frusto-conical portion complementary to the flared portion, and a means for axially forcing the annular seal into the complementary seat.

5. A leakproof seal arrangement as defined in claim 4, wherein the drivehead seal has at least one radially inwardly protruding annular sealing lip, the inner diameter of the sealing lip being selected such that it is radially forced against the centralizer sleeve in the installed condition to reliably prevent leakage of the pumped liquid about the centralizer sleeve.

6. A leakproof seal arrangement as defined in claim 5, further comprising a dirt exclusion seal positioned in the annular gap to prevent dirt suspended in the pumped liquid from reaching the drivehead seal.

7. A leakproof seal arrangement as defined in claim 6, wherein the dirt exclusion seal is a spring loaded seal.

8. A leakproof seal arrangement as defined in claim 5, further comprising a packing positioned in the annular gap for providing a back-up seal for the drivehead seal.

9. A leakproof seal arrangement as defined in claim 1, wherein the means for rotatably supporting the centralizer sleeve is a radial bearing.

10. A leakproof seal arrangement as defined in claim 1, wherein wear of the centralizer sleeve by the drivehead seal is substantially prevented by surface hardening or hard metal plating.

11. A leakproof seal arrangement as defined in claim 9, wherein the drivehead includes an axially protruding cylindrical mounting collar which is coaxial with the bore, and the radial bearing is enclosed in a bearing housing which is coaxially affixed to the mounting collar.

12. A leakproof seal arrangement as defined in claim 11, wherein the drivehead seal is made of elastically deformable seal material and has a substantially cylindrical shape with a radially outwardly flared portion, the mounting collar has a seal receiving, cylindrical internal seat with a complementary frusto-conical portion, and the bearing housing has a radially extending end wall for engagement with an end wall of the drivehead seal, the drivehead seal mounting collar and the bearing housing being shaped and constructed such that the flared portion of the drivehead seal is axially pushed into the complementary seat by the end wall of the bearing housing when the bearing housing is mounted onto the seal mounting flange thereby preventing the drivehead seal from rotating in the receiving bore of the drivehead.

13. A leakproof seal arrangement as defined in claim 12, wherein the drivehead seal has at least one radially inwardly protruding annular sealing lip, the inner diameter of the sealing lip being selected such that the sealing lip is radially, forced against the centralizer sleeve.

14. A leakproof seal arrangement as defined in claim 1, wherein the drivehead seal is made of a high temperature resistant, duroelastic material to provide a drivehead seal of extended service life.

15. A leakproof seal arrangement as defined in claim 14, wherein the drivehead seal is made of a perfluorocarbon or fluorocarbon elastomer.

16. A leakproof drivehead for a downhole rotary pump driven by a drive string rotating in a production tubing, the drivehead comprising:

a bore in fluid communication with the production tubing and sized to permit passage of a polished rod attached to a top end of the drive string;

a centralizer sleeve for receiving a portion of the polished rod;

means for rotatably supporting the centralizer sleeve in the drivehead coaxial with the bore, whereby an annular gap is created between the centralizer sleeve and an opposite, cylindrical wall of the drivehead which gap is in fluid communication with the production tubing;

centering means for sealingly and concentrically connecting the centralizer sleeve with the polished rod for simultaneous rotation about the longitudinal axis, the centering means being sufficiently elastic to accommodate wobble of the polished rod in the centralizer sleeve while preventing leakage of a pumped liquid present in the production tubing and the centralizer sleeve during operation of the pump; and an annular drivehead seal for sealing the annular gap which is also filled with the pumped liquid during operation of the pump, to substantially prevent leakage of the pumped liquid from the drivehead.

17. A leakproof drivehead as defined in claim 16, wherein the drivehead seal is made of elastically deformable high temperature resistant seal material and the seal arrangement further includes a means for preventing rotation of the drivehead seal in relation to the drivehead.

18. A leakproof drivehead as defined in claim 17, wherein the centering means is a packing mounted to a top end of the centralizer sleeve.

19. A leakproof drivehead as defined in claim 18, further comprising a dirt exclusion seat positioned in the annular gap to prevent dirt suspended in the pumped liquid from reaching the drivehead seal.

20. A leakproof drivehead as defined in claim 19, wherein the means for rotatably supporting the centralizer sleeve is a radial bearing, the drivehead includes an axially protruding cylindrical mounting collar which is coaxial with the bore, the radial bearing is enclosed in a bearing housing coaxially affixed to the mounting collar, and the drivehead seal is made of an elastically deformable, high temperature resistant seal material and has a radially outwardly flared portion, whereby the mounting collar has a seal receiving, cylindrical internal seat with a complementary frusto-conical portion, and the bearing housing has a radially extending end wall for engagement with an end wall of the drivehead seal, the drivehead seal mounting collar and the bearing housing being shaped and constructed such that the flared portion of the drivehead seal is axially pushed into the complementary seat by the end wall of the bearing housing when the bearing housing is mounted onto the seal mounting flange thereby preventing the drivehead seal from rotating in the receiving bore of the drivehead.

* * * * *

UNITED STATES PATENT AND TRADEMARK OFFICE
CERTIFICATE OF CORRECTION

PATENT NO. : 5,639,227

DATED : June 17, 1997

INVENTOR(S) : ROBERT A.R. MILLS

It is certified that error appears in the above-identified patent and that said Letters Patent is hereby corrected as shown below:

Column 8, line 17, CLAIM 19, delete "seat" and substitute therefore ---seal---

Signed and Sealed this

Twenty-seventh Day of January, 1998

*Attest:*

Bruce Lehman

BRUCE LEHMAN

*Attesting Officer*

*Commissioner of Patents and Trademarks*